US007153282B1

(12) United States Patent
Dudley

(10) Patent No.: US 7,153,282 B1
(45) Date of Patent: Dec. 26, 2006

(54) FINGER MASSAGER

(76) Inventor: Steven Dudley, 2319 N. mountain Ave., Pomona, CA (US) 91767

( * ) Notice: Subject to any disclaimer, the term of this patent is extended or adjusted under 35 U.S.C. 154(b) by 114 days.

(21) Appl. No.: 11/006,232

(22) Filed: Dec. 7, 2004

Related U.S. Application Data

(60) Provisional application No. 60/528,827, filed on Dec. 11, 2003.

(51) Int. Cl.
*A61H 19/00* (2006.01)

(52) U.S. Cl. ..... 601/93; 601/95

(58) Field of Classification Search ..... 601/93–97, 601/133–135, 84, 89, 101, 103
See application file for complete search history.

(56) References Cited

U.S. PATENT DOCUMENTS

| | | | | |
|---|---|---|---|---|
| 2,540,792 | A | 2/1951 | McCready | 128/44 |
| 2,706,980 | A | 4/1955 | Kahn | 128/44 |
| 3,104,662 | A | 9/1963 | Morawetz | 128/52 |
| 3,149,629 | A | 9/1964 | Katz | 128/44 |
| 3,374,784 | A | 3/1968 | Brent et al. | 128/61 |
| 3,633,571 | A | 1/1972 | Shinagawa | 128/44 |
| 3,837,335 | A | 9/1974 | Teranishi | 128/52 |
| 3,874,373 | A * | 4/1975 | Sobel | 601/95 |
| 5,016,617 | A | 5/1991 | Tarlow et al. | 128/52 |
| 5,902,258 | A | 5/1999 | Cziriak | 601/55 |
| 6,190,339 | B1 * | 2/2001 | Imazaike et al. | 601/133 |
| 6,475,171 | B1 | 11/2002 | Williams | 601/98 |

* cited by examiner

*Primary Examiner*—Michael A. Brown
(74) *Attorney, Agent, or Firm*—Goldstein Law Offices P.C.

(57) ABSTRACT

An improved massaging device for obtaining a massaging effect similar to an actual finger massage. Multiple finger-like implements provide soft wide area skin contact, and generate a vibratory motion consisting of a pulling massage combined with a lateral side motion. The device comprises means of reciprocally moving rows of massaging implements in opposition while reciprocally moving each row in combined normal and parallel unison. In one embodiment, the lateral opposing motion is combined with the normal pulling motion by means of lifting curved implements through fixed but adjustable spaced narrow openings. The lifting motion is generated from an eccentric mechanism, which when rotatably driven, may also produce the lateral parallel motion. Lateral parallel motion amplitude may be adjusted relative to the pulling motion by choice of eccentric dimensions.

2 Claims, 6 Drawing Sheets

FINGER MASSAGER

CROSS REFERENCES AND RELATED SUBJECT MATTER

This application is a continuation of provisional patent application Ser. No. 60/528,827, filed in the United States Patent Office on Dec. 11, 2003.

BACKGROUND OF THE INVENTION

The invention relates to a massaging device, and more particularly, to an implementation producing the combined effect of a pulling finger massager with lateral skin stretching machine. While not limited thereto, the invention finds special application when applied to the scalp. Since scalp skin is relatively tightly drawn over the skull, the side motion, combined with an upward pull, provides the same stimulation benefits obtainable from an experienced masseur.

Various devices exist which will stimulate the skin, some which are handheld. For example, U.S. Pat. No. 2,540,792 to McCready describes a device in which the skin is contacted with bristles which are mounted on a floating plate which is vibrated normal to the skin. Varients of this device exist in which the plates containing bristles in fixed relationship to each other are vibrated parallel to the skin surface. Such devices, when applied to relatively tight skin structures such as the scalp, tend to impart horizontal skin tension and compression forces.

In a device for scalp massaging, Kahn in U.S. Pat. No. 2,706,980, moves a group of skin contacting fingers laterally toward a stationary group of similar fingers. Thus, achieving a reciprocating horizontal skin squeezing motion.

The desirability of a "pulling massage" in which the fingers apply lateral pressure while pulling off in normal direction away from the skin, is noted by Shinagawa and Nozato in U.S. Pat. No. 3,633,571. In their device, a pair of annular massaging implements are mounted on supporting members so as to be rotatable around an axis eccentric to and inclined with respect to a driving shaft. The resulting pinching and pulling motion is said to produce the same massaging effect as a manual pulling massage.

Real finger action however, frequently adds a lateral vibratory motion superimposed upon a gentle squeeze and pull motion in which the fingers do not lose contact with the skin. Such motion thus will produce large area horizontal skin stretch, as well as localized normal pull. The combined action will thus provide both improved blood circulation and increased pleasurable stimulation.

While these units may be suitable for the particular purpose employed, or for general use, they would not be as suitable for the purposes of the present invention as disclosed hereafter.

SUMMARY OF THE INVENTION

It is an object of the invention to provide a massaging device, which will separately produce an improved pulling massage which may be variably combined with horizontal skin stretching stimulation.

It is a further object to provide a massaging device which will produce a feel and motion similar to that manually received from the fingers of an experienced masseur.

It is further an object to provide the combined motion from a single massaging device.

It is further an object to provide the desired complex motion from a single device, which will be relatively cheap to build.

The invention takes the form of a handheld machine with a plurality of opposing finger-like curved massaging implements. Through an eccentrically operated finger support frame, working on finger ends beyond a fulcrum point, opposing pairs of the skin engaging ends of the fingers move toward each other as they move upward, while at the same time they move laterally together in a plane normal to the vertical motion. The resulting combined motion thus stimulates a manual massage.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
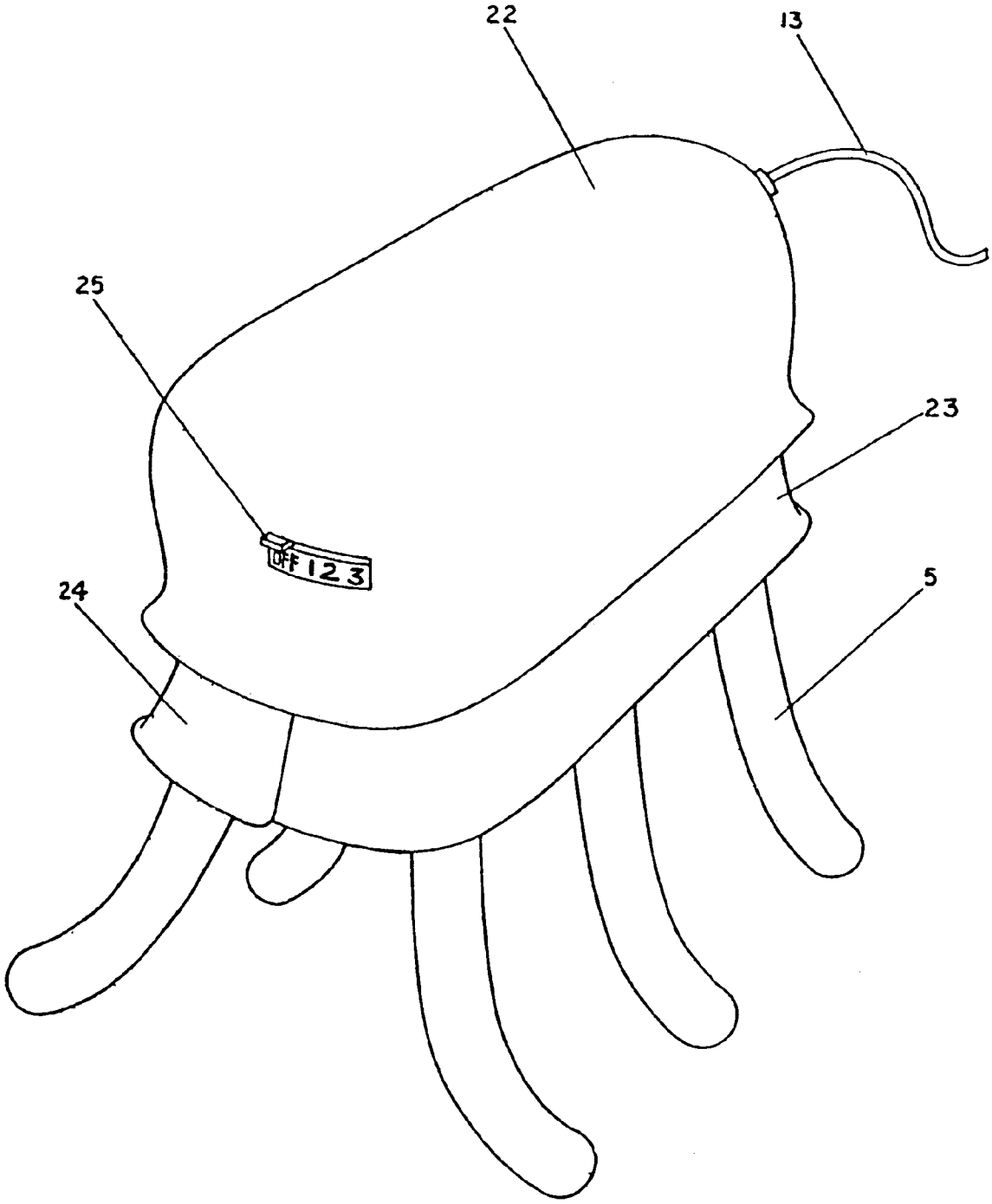
FIG. 1 is a front isometric view of an embodiment employing principles of this invention.
Figure 2:
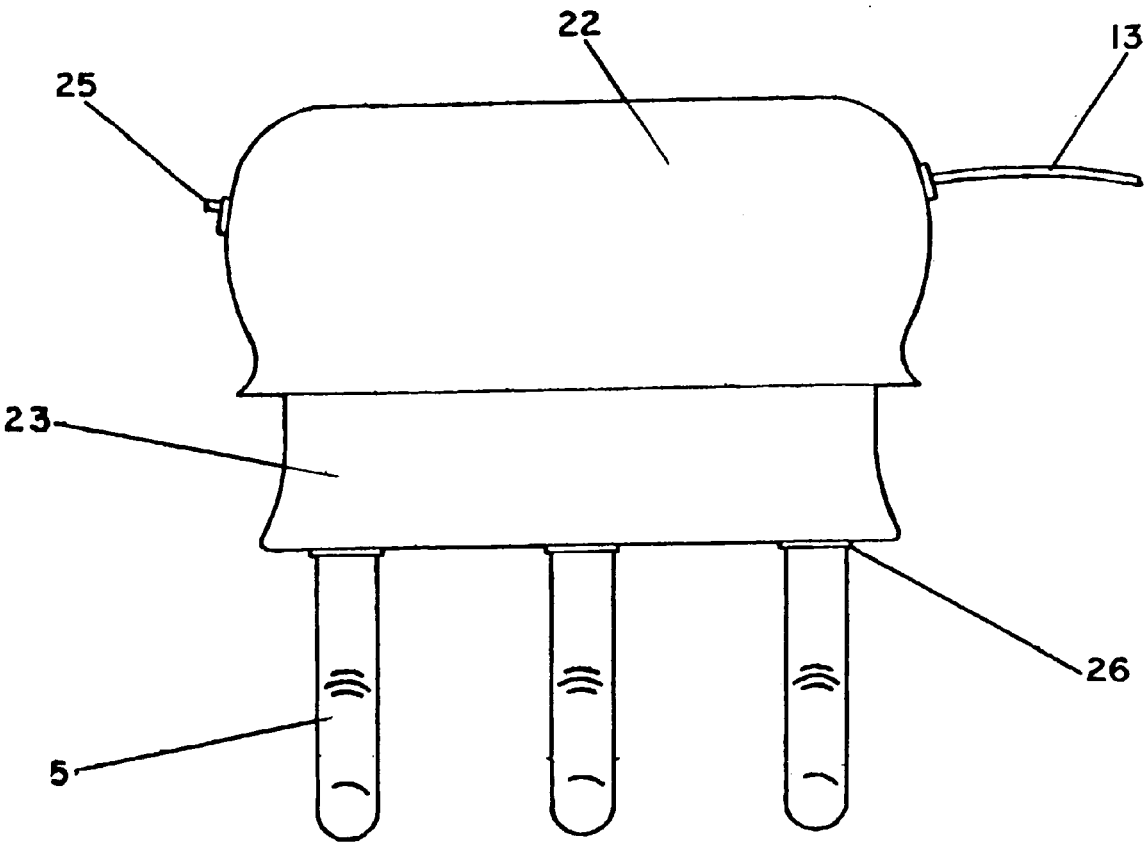
FIG. 2 is a side elevational view of the above embodiment.
Figure 3:
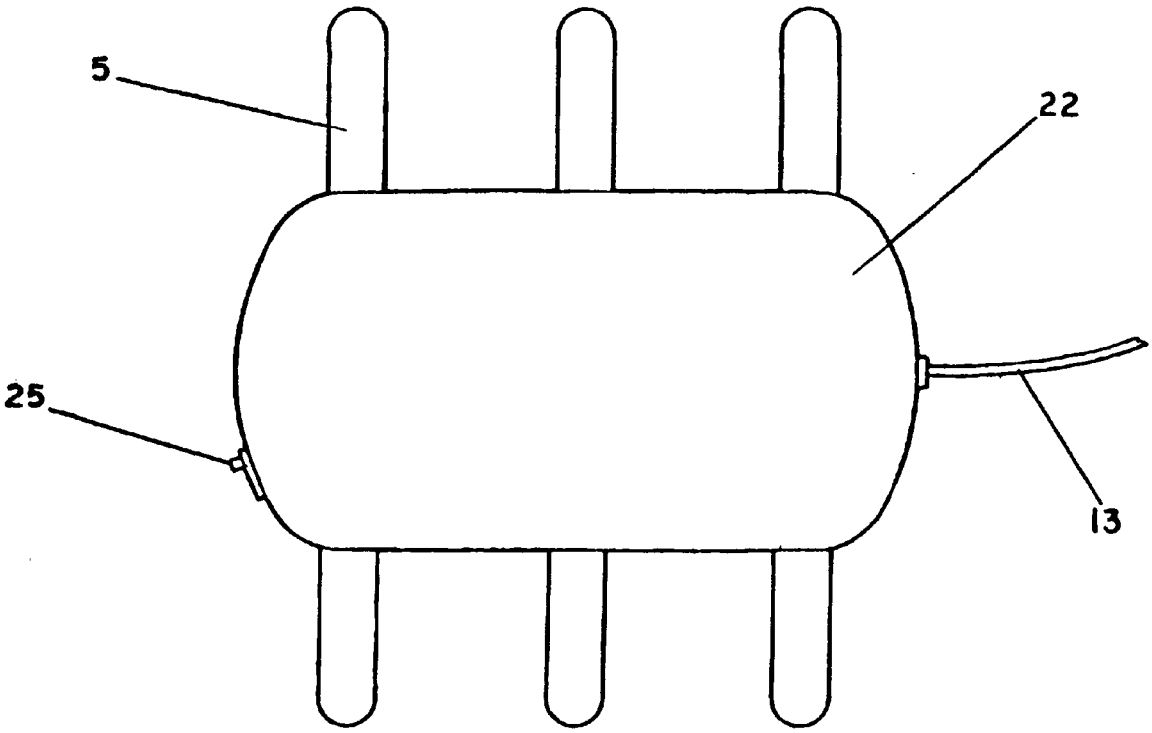
FIG. 3 is a top view of the same embodiment.

In the embodiment illustrated, a housing assembly provides support for the internal mechanisms and consists of a top housing member 22, and a lower housing structure that includes two lower housing members, 23 and 24. Said lower members 23 and 24 are supported on the upper housing member 22 and pivoted to each other by pin 16 in an adjustable skirt manner. The top housing 22 is made of any suitable rigid structural metal or plastic, and is contoured to fit comfortably in the palm of a hand of an operator. Cutouts in said top housing 22 provide access for an electrical power cord 13, and for a combined power speed switch 25, as shown in FIG. 1. Projecting downwardly and outwardly from each said lower housing members 23 and 24, are three massaging implements, or fingers 5. Said fingers 5 each slideably extend through bushings 26 pressed in openings in said lower members 23 and 24. These implements are made of any suitable finger-like material such as rubber or vinyl coated metal or strong solid plastic, which will provide a comfortable non-abrasive contact with the skin.

Figure 4:
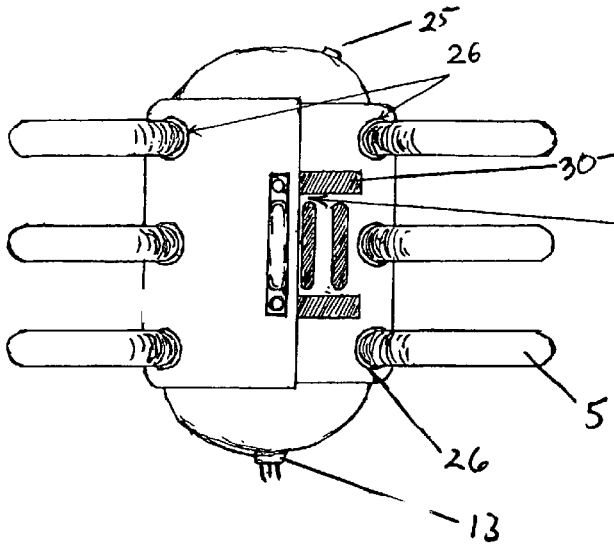
FIG. 4 is a bottom view of the same embodiment.
Figure 6:
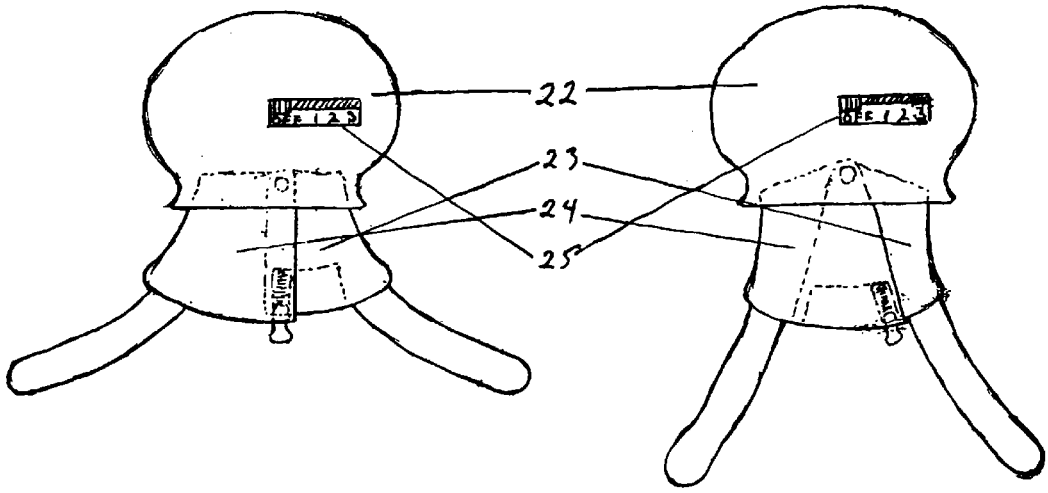
FIG. 6 is a front view of the same embodiment.

Referring to FIG. 4, the lower housing member 24 is made to overlap and adjustably lock with the lower housing member 23. The locking adjustment is such that when locked with minimum overlap, as in FIG. 6, each set of the three fingers 5, is expanded a maximum distance from the opposing set of the three fingers 5. When adjusted and locked with maximum overlap, the two lower housing members 23 and 24 act in tight skirt fashion to draw the opposing sets of fingers 5 toward each other, as shown in FIG. 7.

Figure 5:
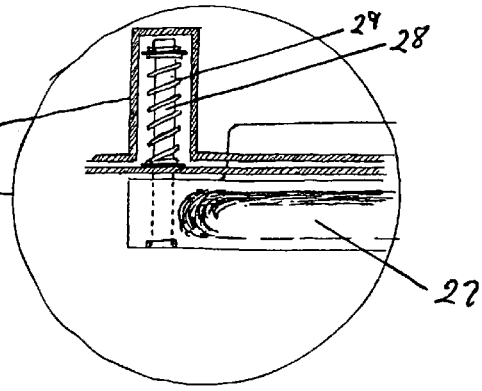
FIG. 5 is an expanded sectional view taken along line 5—5 of FIG. 4.

FIG. 5 shows a cross-section of the adjustment lock mechanism. The lock contains a combined handle lock assembly 27 which is carried on lower housing member 24, and is spring loaded to bear downward and positively engage detent slots in lower housing member 23. The upper handle portion of said lock assembly 27 is shaped with a hole to facilitate grasping to release the lock by lifting upward. Connecting rods 28 extend through holes in lower housing member 24, and provide rigid attachment to the lower end of the compressing spring 29. The upper end of said compression spring 29 bears against the underside of lower housing member 24 so as to force the connecting rod 28 and the attached handle 27 downward against lower housing member 23. Room for rotary adjustment movement of connecting rods 28 is provided by slots 30 cut in lower housing member 23.

Figure 7:
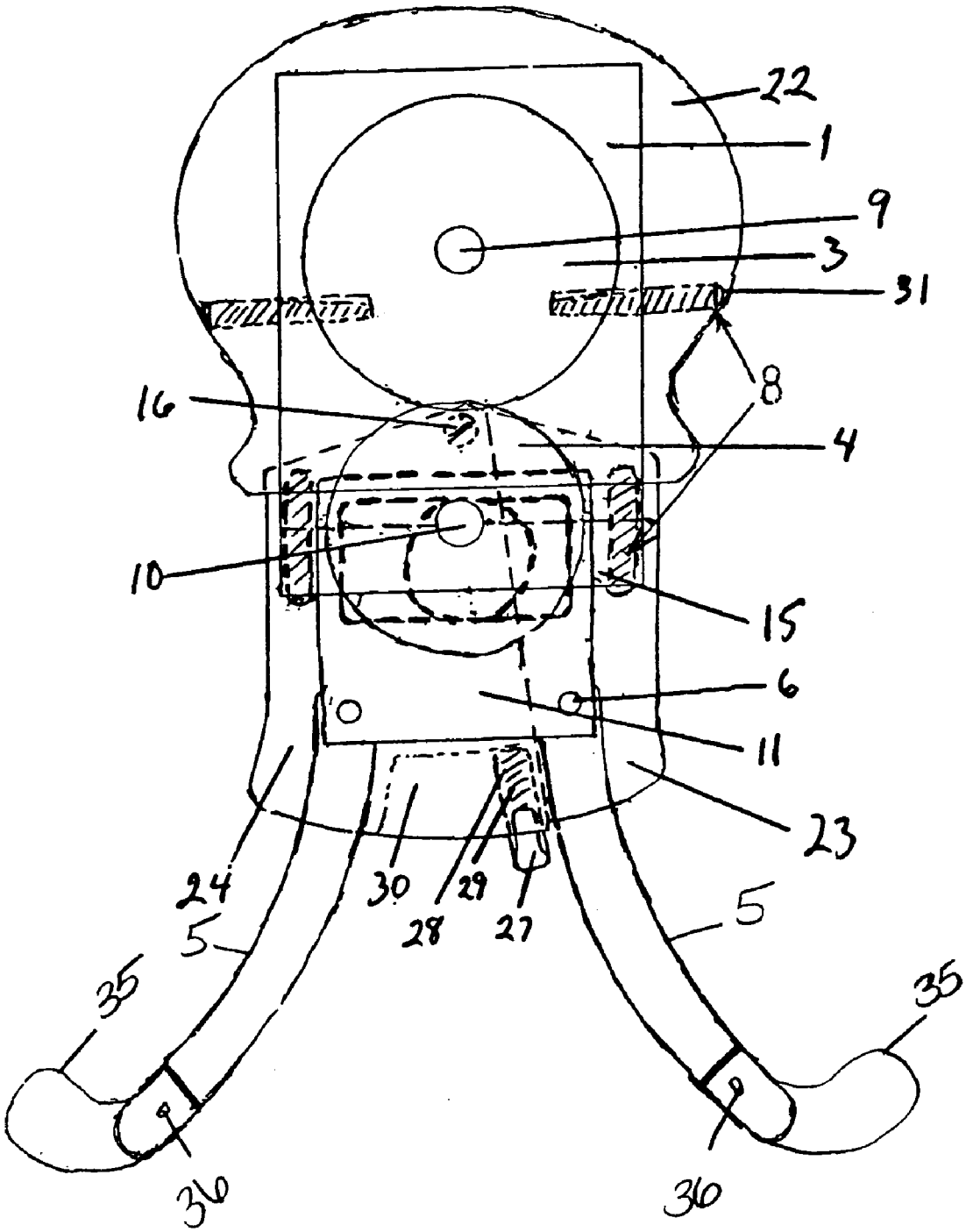
FIG. 7 is a lateral partial sectional viewed from the front.

Referring to the transparent front view FIG. 7, an upper member inner support plate 1, containing four tapped holes 8, is attached to the upper housing member 22 by means of four screws 31, arranged two per side. Four additional screws 31 are used to rigidly support motor 2 to the upper housing member 22 by means tapped holes 8 in the stator housing for said motor 2. A lower member inner support plate 15 is attached to said upper member 1 by mean of four screws 14, such detachment means being provided for ease of assembly.

Each of the massaging implement fingers 5, are loosely fitted on the support rods 6, three per side, which are supported at each outward end by journal holes in finger support frame 11. Axial movement of said support rods 6 is limited by restraining means such as a pin 7. As shown in FIG. 7, reversible ball tips 35 maybe secured to the ends of the fingers 5 for additional fingertip feel. In addition, the ball tips 35 are reversible and rotatable around the ends of the fingers 5 to face inward or outward as desired. The ball tips 35 adjustably attach to the ends of the fingers 5 by a fastener 36 thereby allowing the ball tips 35 to be secured in a plurality of reversible positions around the fingers 5.

Finger support frame 11 is revolvably supported by the eccentrics 20 on each outward side face of said frame 11. Each eccentric 20 is equally off axis relative to frame driving shaft 10, such that both left-right and up-down motion is imparted to the frame 11 as viewed in FIG. 7. Since each finger 5 is fulcrumed at the point of contact with grommet 26, and upward motion of frame 11 move opposing fingers 5 toward each other as they are pulled up. Side motion of frame 11 will result in exaggerated opposite direction side motion of each fingertip; however, the spacing between fingertips will not change. This side motion will be in addition to and in a plane normal to said upward pulling motion. The magnitude of the side motion imparted relative to the vertical motion is controlled by the design choice of the shape and the upper supporting portion of support frame 11 in contact with the eccentrics 20. A square cross-shaped upper supporting portion about the eccentric, as illustrated in FIG. 7, will produce equal motion in both directions. An increase in the lateral dimensions of the cross section of the upper supporting portion will reduce side motion imparted in the direction of the lengthened dimension. For illustrative purposes, a square cross section is shown in the preferred embodiment of FIG. 7 which will equalize the side motion and retain the improved pulling motion. This variation in the relative magnitudes of each vibratory component will allow use of the preset machines, which are optimized for various portions of the body.

Figure 8:
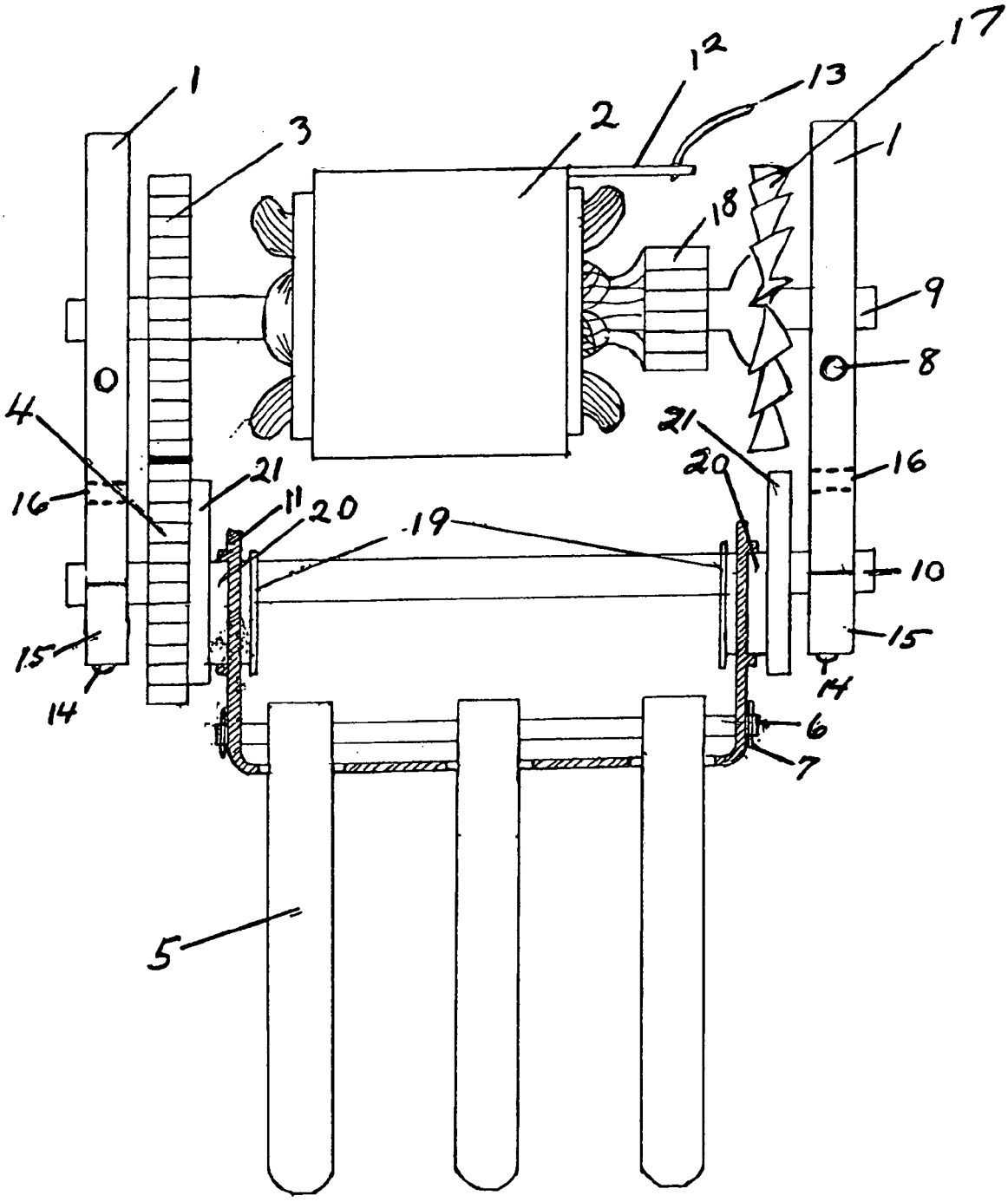
FIG. 8 is an expanded sectional of the interior assembly, viewed along lines 8—8 on FIG. 8.

Referring to FIG. 8, support frame 11 is axially constrained on eccentric 20 by means of lip 19 and by eccentric support plate 21. Said support plate 21 is rigidly attached to both eccentric 20 and to gear 4.

Driving source means for turning frame drive shaft 10 is shown in this embodiment, as a conventional small universal motor 2. The rotor 18 of said motor 2 is rigidly connected through shaft 9 and gears 3 and 4 to frame drive shaft 10. Electrical power supply means are connected to motor 2 through wire 13, and self-cooling is provided by fan 17 mounted on rotor shaft 9. Although not shown, any convenient electrical supply may be used, including battery packs or AC or DC power lines. Likewise, the specific gear train ratios may be altered to produce the output finger torque and speed desired for specific massage applications.

In operation, the device will be placed down upon the part of the body to be massaged, such as the neck, the shoulders, the back, the scalp, or the leg. Over a part such as the arm, the multiple implements will provide soft wide area contact, as would actual finger sides. Over a part such as the scalp, reduced area tip contact will move the skin. The side motion of the fingertips will move the skin against the skull, for instance, and stretch it thereby. At the same time, the vertical movement will produce a gentle squeeze and pull upward, normal to the plane of side motion. The magnitude of the vertical movement relative to the side motion will have been determined by selection from a family of devices. The resulting combined motion will therefore more closely approximate the finger motion of an experienced masseur working a given area.

In conclusion, herein is presented a finger massager. The invention is illustrated by example in the drawing figures, and throughout the written description. It should be understood that numerous variations are possible, while adhering to the inventive concept. Such variations are contemplated as being a part of the present invention.

What is claimed is:

1. A massaging device, for massaging a user having a body, comprising:

a top housing structure;

a lower housing structure having a base with implement openings, and a pair of lower housing members that are pivotally connected with a pin;

a plurality of curved massaging implements extending in adjustably aligned opposing rows through the implement openings, the curved massaging implements, each massaging implement having a ball tip for contacting the body that may be selectively rotated and locked in said rotated position to alter massaging action by the curved massaging implements;

an inner support mounted on said top housing structure for providing adjustable moveable support to the massaging implements;

an actuating mechanism carried by the top housing for reciprocally moving the implement rows in opposition while reciprocally moving each row in combined normal and parallel unison relative to the lower housing base; and wherein the lower housing structure further has an adjustment mechanism for setting spacing between the implement rows by adjusting relative positioning of the lower housing members.

2. The massaging device as recited in claim 1, wherein the actuating mechanism comprises:

a mechanism to vertically draw the curved implements perpendicularly through the implement openings in the lower housing base to produce combined reciprocal opposing and normal motion; and a side actuation mechanism to reciprocally move the implement rows parallel to the lower housing base in unison.

* * * * *